United States Patent [19]

Eslinger

[11] 4,330,240

[45] May 18, 1982

[54] ROTARY COMPRESSOR WITH COMMUNICATION BETWEEN CHAMBERS TO PROVIDE SUPERCHARGING

[75] Inventor: Ralph G. Eslinger, Elyria, Ohio

[73] Assignee: The Bendix Corporation, Southfield, Mich.

[21] Appl. No.: 121,088

[22] Filed: Feb. 13, 1980

[51] Int. Cl.[3] ..... F04C 18/00; F04C 29/08

[52] U.S. Cl. ..... 418/1; 418/54

[58] Field of Search ..... 418/1, 54, 61 A, 61 R, 418/180; 417/310, 440

[56] References Cited

U.S. PATENT DOCUMENTS

| | | | |
|---|---|---|---|
| 1,636,486 | 7/1927 | Planche | 418/54 |
| 4,105,375 | 8/1978 | Schindelhauer | 418/54 |
| 4,118,157 | 10/1978 | Mayer | 418/54 |
| 4,222,715 | 9/1980 | Ruf | 417/310 |

FOREIGN PATENT DOCUMENTS

| | | | |
|---|---|---|---|
| 907575 | 7/1945 | France | 418/54 |

*Primary Examiner*—John J. Vrablik

*Attorney, Agent, or Firm*—Ken C. Decker; W. N. Antonis

[57] ABSTRACT

A rotary air compressor includes a rotor which rotates within a housing and controls communication through inlet and outlet ports provided on the housing and compresses air communicated through the inlet port for delivery to the outlet port. The inlet and outlet ports are provided with check valves controlling communication therethrough. After the rotor rotates through a dead-center position, the check valves in both the inlet and outlet ports are closed. The rotor then rotates into a position in which the apex seals carried by the rotor wipe across the inlet and outlet ports simultaneously, thereby opening a communication path bypassing the apex seals so that the pressure levels in the chambers across the rotor are equalized. As the rotor continues to rotate, air is compressed and communicated to the outlet port.

15 Claims, 5 Drawing Figures

ROTARY COMPRESSOR WITH COMMUNICATION BETWEEN CHAMBERS TO PROVIDE SUPERCHARGING

BACKGROUND OF THE INVENTION

This invention relates to a rotary fluid compressor for automotive vehicles.

Existing automotive vehicles, such as air braked trucks, use reciprocating piston air compressors to provide a source of compressed air. However, rotary air compressors offer significant advantages over the older reciprocating piston compressors. The present invention relates to a rotary compressor in which a two-lobed rotor rotates within an epitrochoidal housing to compress air. The air is then communicated to storage reservoirs for use in the vehicle air brake system and to operate vehicle accessory devices that depend upon air pressure. Many prior art rotary compressors are inefficient, noisy, and do not run smoothly, so they have generally not been used on automotive vehicles. The prior art compressors are relatively inefficient because they do not make efficient use of the displacement volume. They do not run smoothly, because they are designed such that a reversing torque is applied to the rotor during some portions of its angular movement, thereby introducing vibration. These prior art compressors are often noisy, because they discharge compressed air to atmosphere through the inlet port during some phases of their operation, thereby causing an unpleasant "popping" sound, and additional reductions in efficiency. When used on a vehicle, this "popping" sound is so loud that it may cause the compressor to violate the noise standards of governmental agencies.

SUMMARY OF THE INVENTION

The present invention relates to a rotary compressor in which the volume of air in the chamber which is about to undergo a compression cycle is supercharged by communicating compressed air in the other chamber into the chamber about to undergo compression, thus effecting a supercharging of the last-mentioned chamber. The air used to effect a supercharging of the chamber about to undergo compression is air that would otherwise be discharged to atmosphere through the inlet port, thus causing the unpleasant "popping" sound, and would otherwise also act upon the rotor to cause troublesome reversing torques, thereby preventing smooth running of the rotor.

Therefore, an important object of my invention is to provide a rotary fluid compressor that is more efficient than prior art devices by designing the compressor so that all available displacement volume is used efficiently, and by supercharging the compression chamber of the fluid compressor at the beginning of each compression cycle.

Still another important object of my invention is to reduce or eliminate undesirable noise generated by prior art rotary air compressors by preventing the escape of compressed air to the atmosphere through the inlet port.

Still another important object of my invention is to provide a rotary fluid compressor which operates more smoothly than do prior art devices, by eliminating undesirable reversing torques on the rotor.

Still another important object of my invention is to be able to vary the output flow of a rotary compressor by varying the position of the rotor at which compression begins to occur, without altering the physical size of the compressor.

DETAILED DESCRIPTION

Figure 1:
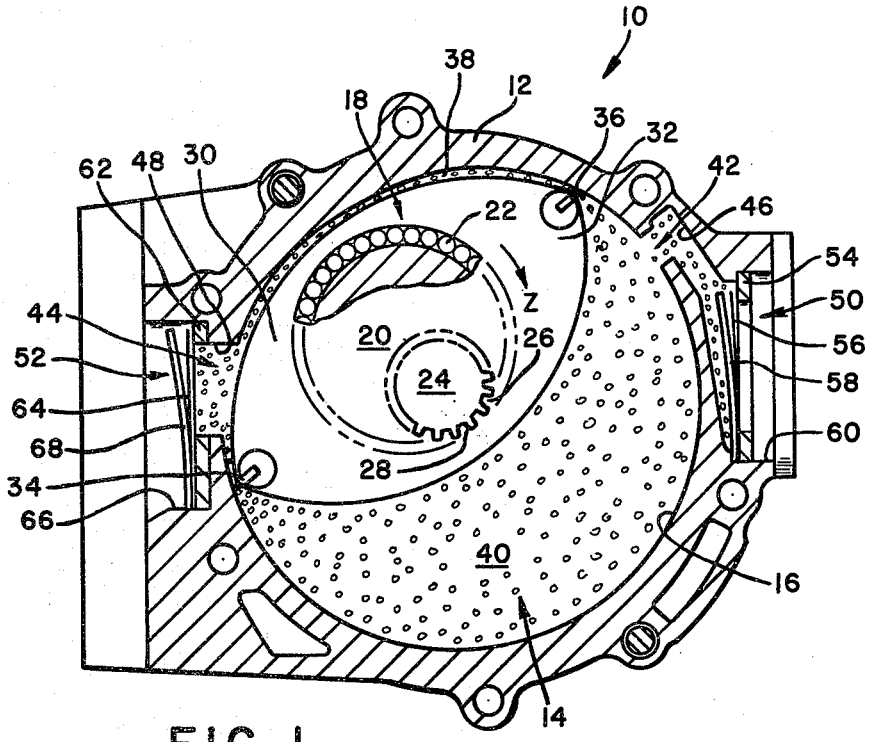
FIG. 1 is a transverse cross-sectional view of a rotary air compressor made pursuant to the teachings of my present invention.

Referring now to the drawing, a rotary compressor generally indicated by the numeral 10 includes a housing 12 defining a cavity 14 therewithin. The peripheral wall 16 of the cavity 14 defines an epitrochoidal tract for a rotor generally indicated by the numeral 18. The rotor 18 is mounted on an eccentric 20 through bearings 22. The eccentric 20 is fixed to a shaft 24 which extends through the sidewalls (not shown) of the housing 12 and is turned by the vehicle engine. Timing gears 26, 28 are carried on the rotor 18 and on the side plate respectively. The design of the rotor 18, and the manner in which it is carried on the eccentric 20 and shaft 24, is conventional, and is more fully described in U.S. Pat. No. 4,118,157, owned by the assignee of the present invention, and incorporated herein by reference. The rotor 18 includes a pair of opposed lobes 30, 32. Each of the lobes 30, 32 carries an apex seal 34, 36 of conventional design. Each of the apex seals 34, 36 wipe around the peripheral wall 16, sealingly engaging the latter, to divide the cavity 14 into a pair of chambers 38, 40.

An inlet port 42 and a discharge or outlet port 44 are provided in the wall 16 of the cavity 14. The ports 42 and 44 are located such that when one of the seals 36 or 38 wipes across the port 42, the other seal wipes across the port 44. Furthermore, as can be seen in FIG. 1, the ports 42, 44 extend circumferentially around the wall 16 for a distance greater than the width of the seals 34, 36, so that, at predetermined angular positions of the rotor 18, the seals 34, 36 will wipe across the ports 42, 44 such that communication is permitted between the chambers 38, 40 around the periphery of the seals 34, 36. The ports 42 and 44 communicate with an inlet passage 46 and a discharge passage 48. Check valves 50, 52 are located in the inlet passage 46 and discharge passage 48 respectively. Check valve 50 includes a valve seat 54 which cooperates with a reed 56 to control communication into the inlet passage 46. A valve stop 58 is provided to limit the movement of the reed 56. Accordingly, check valve 50 will be open when the pressure level at port 42 is less than the pressure level upstream of the check valve 50. The outlet 60 of the inlet passage 46 communicates with atmosphere, or engine supplied air. The check valve 52 includes a valve seat 62 which cooperates with a reed 64 to control communication between the cavity 14 and the discharge passage 66. A valve stop 68 limits movement of the reed 64. The discharge passage 66 communicates with a fluid reservoir or other appropriate storage facility for compressed air.

MODE OF OPERATION

In the ensuing discussion, the rotor 18 is always assumed to be rotating in a clockwise direction viewing the Figures, as indicated by the arrow Z in FIG. 1. Referring now to FIG. 1, the rotor 18 is illustrated in its top dead-center position, in which the volume of the chamber 38 is minimized and the volume of the chamber 40 is maximized. Of course, just prior to the movement of the rotor 18 into the top dead-center position illustrated in FIG. 1, the volume of the chamber 38 are steadily decreasing, thereby compressing the air in the chamber 38. Because the pressure of the compressed air in chamber 38 is greater than the air pressure at the outlet 66 of the discharge passage 48, check valve 52 was open to communicate pressurized fluid to the aforementioned reservoir. Similarly, the volume of chamber 40 was steadily decreasing before the rotor 18 attained the top dead-center position illustrated in FIG. 1. Since the volume of chamber 40 was steadily increasing, the check valve 50 was held open to permit communication of air into the chamber 40.

Figure 2:
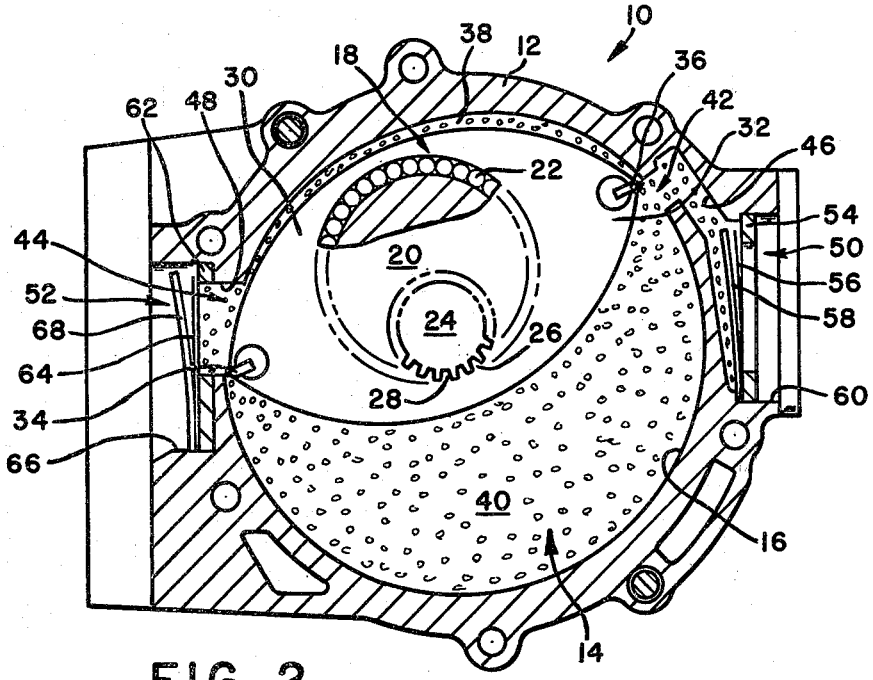
FIGS. 2–4 are views similar to FIG. 1 illustrating the air compressor made pursuant to my present invention with the position of the rotor illustrated in its various operating positions.
Figure 5:
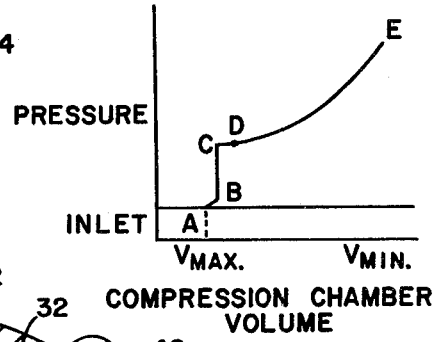
FIG. 5 is a graphical representation of the output characteristics of the rotary compressor illustrated in FIGS. 1–4.

However, as the rotor 18 rotates past the top dead-center position, the volume of the chamber 38 begins to increase. Accordingly, because of the increase in volume, the pressure level in the chamber 38 begins to drop. This decrease in pressure causes the check valve 52 to close, thereby terminating communication between the aforementioned reservoir and the chamber 38. Similarly, as the rotor 18 rotates past the top dead-center position illustrated in FIG. 1, the volume of chamber 40 begins to decrease. This decrease in the volume causes the air therein to be compressed, thereby increasing the pressure level in chamber 40 to maintain the check valve 50 closed. Accordingly, after the rotor rotates past the top dead-center position illustrated in the drawing, both the inlet check valve 50 and the outlet check valve 52 are closed. Reference is made to FIG. 2, which illustrates the position of the rotor just before the apex seals 36 and 34 begin to wipe across the inlet port 42 and outlet or discharge port 44 respectively. The increase in volume of the chamber 38 and the decrease in volume of the chamber 40 is apparent. Referring now to FIG. 5, which illustrates graphically the pressure level in the chamber 40, it is noted that the pressure level in the chamber 40 as illustrated in FIG. 1 is substantially at inlet pressure when the rotor is disposed in the top dead-center position in which the volume of chamber 40 is maximized. This point is illustrated by point A in FIG. 5. The increase in pressure level in the chamber 40 due to the rotation of the rotor between the top dead-center position illustrated in FIG. 1 and its position illustrated in FIG. 2 is indicated by line segment A-B in FIG. 5.

Figure 3:
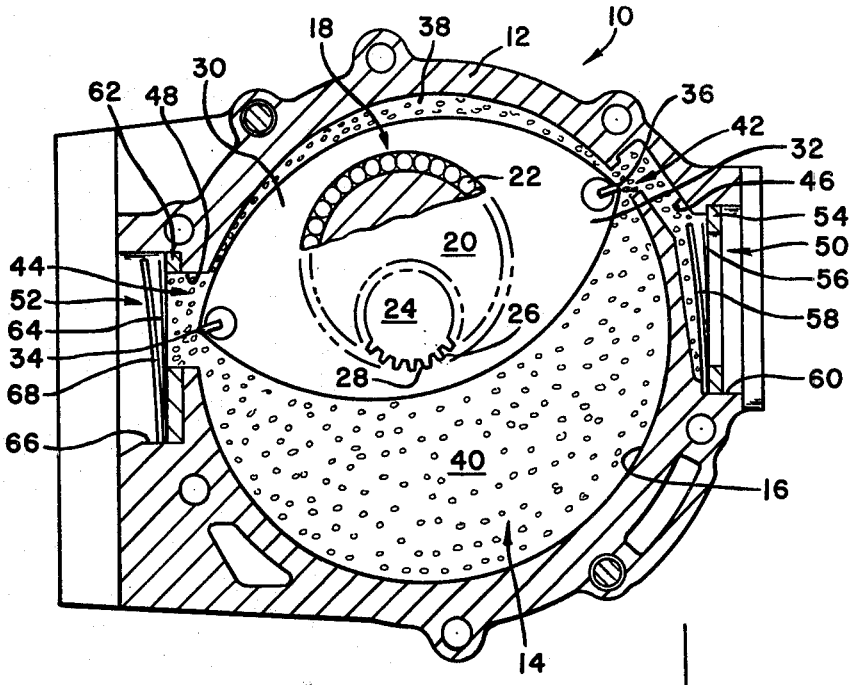

Referring now to FIG. 3, the position of the rotor 18 is illustrated after an incremental rotation past the position illustrated in FIG. 2 has taken place. In this position, both the seals 34 and 36 wipe across the inlet and outlet ports 42, 44. Since, as discussed hereinabove, the circumferential distance around the peripheral wall 18 through which the inlet and outlet ports 42 and 44 extend is greater than the width of the seals, a pair of bypass passages around the tips of the apex seals 34 and 36 are open. These bypass passages extend through the inlet and outlet ports 42, 44 respectively, so that the fluid in chamber 38 is communicated with the fluid in chamber 40. Of course, it must be remembered that both of the check valves 50, 52 closed as the rotor rotated past the top dead-center position illustrated in FIG. 1. The check valves remain closed in the position illustrated in FIG. 3, since the pressure levels in both of the chambers 38 and 40 remain at greater than atmospheric pressure, thereby maintaining the inlet check valve 50 closed. The discharge check valve remains closed when the rotor rotates into the position illustrated in FIG. 3 because the pressure level in chamber 38 when the rotor is in this position is less than the pressure level in the chamber 38 at the top dead-center position illustrated in FIG. 1. With the bypass passages open as illustrated in FIG. 3, the pressure levels in the chambers 38 and 40 equalize at a pressure level intermediate the pressures theretofore existing in the chambers 38 and 40. This "superchanging" of the chamber 40, in which the pressure level therein is abruptly increased by communicating it to the pressure level in chamber 38, is illustrated by line segment B-C in FIG. 5. The superchanging of the chamber 38 increases the efficiency of the compressor over compressors known to the prior art because the abrupt increase in the pressure level in chamber 40 is accomplished without further rotation of the rotor 18. Furthermore, the pressure in the chamber 38, if it were not communicated to the chamber 40 would have to have been discharged to atmosphere through the passage 46, thereby causing an annoying "popping" sound. Finally, the pressure level in the chamber 38 in prior art devices would have exerted an undesirable reversing torque on the rotor 18.

Figure 4:
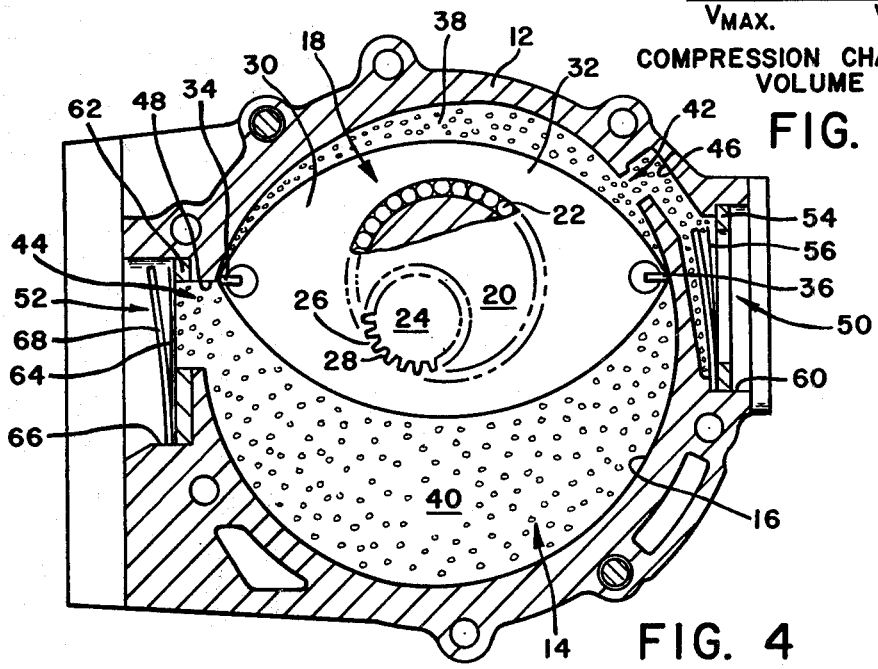

It should be noted that the width of discharge port 44 is greater than the width of the inlet port 42, so that the inlet port 42 is communicated to the chamber 38 and is closed to the chamber 40 while the discharge port remains communicated to the chamber 38. Accordingly, no air can be compressed until the apex seal 34 wipes to the end of the discharge port 44 as illustrated in FIG. 4. The fluid in chamber 40 is not being compressed during this cycle as illustrated by the substantially flat line segment C-D in FIG. 5. Accordingly, it is possible to limit the output flow from the compressor to a predetermined level without changing the compressor housing if necessary for a particular application of the compressor. This can be done by enlarging the discharge port 44, thereby increasing the time that the seals wipe past the discharge port when no air is being compressed. After the rotor rotates past the position illustrated in FIG. 4, the air in the compression chamber 40 is compressed as indicated by line segment D-E in FIG. 5, until the rotor again reaches the top dead-center position illustrated in FIG. 1.

I claim:

1. A method of compressing fluid using a rotary fluid compressor including a housing defining a cavity therewithin having opposed inlet and outlet ports, a rotor rotatable in said cavity, said rotor having a pair of opposed apexes wiping the wall of said cavity to divide the latter into a pair of chambers, an inlet port check valve for permitting fluid communication through said inlet port into said cavity but preventing communication of fluid from said cavity through said inlet port, and an outlet port check valve for permitting fluid communication from said cavity through said outlet port but preventing communication into said cavity through said outlet port, said method comprising the steps of communicating one of the chambers with the inlet port and the other chamber with the outlet port, rotating said rotor with both of said check valves open to compress the fluid in said other chamber until the rotor attains a dead-center position in which the volume of said other chamber is minimized and the volume of said one chamber is maximized, closing both of said check valves at substantially the same time as said rotor rotates past said dead-center position, and continuing to rotate said rotor past said dead-center position into a position wherein at least one of said ports is communicated to both of said chambers while both of said check valves remain closed and thereafter continuing rotation of said rotor to communicate said one chamber to the outlet port and the other chamber to the inlet port while permitting said check valves to open.

2. The method of claim 1:

including the step of simultaneously wiping each of said apexes across a corresponding one of said ports as said rotor rotates within said housing so that both of said ports are simultaneously communicating with both of said chambers.

3. The method of claim 2:

including the step of bypassing fluid from said other chamber into said one chamber through said ports around the apexes of said rotor when the latter are wiping across said ports.

4. The method of claim 1:

including the step of expanding the volume of said other chamber as the rotor rotates past the dead-center position and before said one port is communicated to both of said chambers.

5. The method of claim 1:

wherein both of said ports are simultaneously communicated to both of said chambers after said rotor rotates past said dead-center position, said ports thereby permitting the pressure levels in said chambers to equalize.

6. A method of compressing fluid using a rotary fluid compressor including a housing defining a cavity therewithin having inlet and outlet ports, a rotor rotatable in said cavity, said rotor having a pair of opposed apexes wiping the wall of said cavity to divide the latter into a pair of chambers, an inlet port check valve for permitting fluid communication into said cavity but preventing communication of fluid from said cavity through said inlet port, an outlet port check valve for permitting fluid communication from said cavity but preventing fluid communication into said cavity through said outlet port, said method comprising the steps of communicating one of the chambers with the inlet port and the other chamber with the outlet port, rotating said rotor with both of said check valves open to compress the fluid in said other chamber until the rotor attains a dead-center position in which the volume of said other chamber is minimized and the volume of said one chamber is maximized, closing both of said check valves at substantially the same time as said rotor rotates past said dead-center position, opening a bypass passage around the tip of at least one of said apexes while said check valves are closed to permit communication between said chambers, and closing said bypass passage after the pressures in said chamber equalize.

7. The method of claim 6:

wherein a bypass passage extends around the tips of both of said apexes so that fluid is bypassed through each of said ports.

8. The method of claim 7:

wherein said bypass passages extend through the inlet and outlet ports.

9. The method of claim 7:

wherein the step of opening said bypass passages is effected by rotating the rotor into a position in which one of the apexes wipes across the inlet port and the other of said apexes wipes across the outlet ports, the circumferential width of said ports being greater than the thickness of the apexes whereby said bypass passages are defined by said inlet and outlet ports.

10. In a rotary air compressor, a housing defining a cavity therewithin having a peripheral wall, an inlet port and an outlet port in said peripheral wall, a rotor rotatable in said cavity, said rotor having a pair of opposed apexes wiping said peripheral wall to divide said cavity into a pair of chambers, one of said chambers being communicated to said inlet port and the other chamber being communicated to the outlet port, said inlet and outlet ports being located in said peripheral wall such that the tip of each of said apexes wipes across one of said ports when the other apex wipes across the other of said ports, at least one of said inlet and outlet ports communicating with both of said chambers when the rotor is in a predetermined angular position in which said apexes wipe across the ports, an inlet port check valve permitting communication into said cavity through said inlet port but preventing communication in the reverse direction, and an outlet port check valve permitting communication from said cavity through said outlet port but preventing communication in the reverse direction, said inlet and outlet ports being located on said peripheral wall such that the pressure differentials across the check valves hold said check valves closed when the apexes of the rotor wipe across said ports.

11. The invention of claim 10:

wherein each of said ports extends around said peripheral wall for a distance greater than the width of the tips of the apexes of the rotor, whereby fluid from one chamber can bypass the apexes of the rotor through said ports to communicate into the other chamber.

12. The invention of claim 10:

wherein the inlet and outlet ports communicate simultaneously with both of said chambers through bypass passages around the tips of said apexes, said bypass passages being opened when said rotor is in said predetermined angular position.

13. The invention of claim 12:

wherein said ports define at least a portion of said bypass passages.

14. The invention of claim 10:

an inlet passage communicating with said inlet port, said inlet port check valve being located in said inlet passage, an outlet passage communicating with said outlet port, said outlet port check valve being located in said outlet passage, the portions of said inlet and outlet passages between the check valves and the ports defining bypass passages permitting communication between said chambers when the apexes of the rotor wipe across said ports.

15. The invention of claim 10:

wherein said rotor rotates through a dead-center position in which the volume of said one chamber is maximized and the volume of said other chamber is minimized, said check valves closing as said rotor rotates through said dead-center position, said check valves opening after said rotor rotates through said predetermined angular position.

* * * * *